United States Patent [19]

Eley

[11] 4,103,886

[45] Aug. 1, 1978

[54] PERMANENT ATHLETIC FIELD MARKER

[76] Inventor: Carl W. Eley, Rte. 1, Zanesfield, Ohio 43360

[21] Appl. No.: 777,399

[22] Filed: Mar. 14, 1977

[51] Int. Cl.[2] ..... A63C 19/06

[52] U.S. Cl. ..... 272/3; 273/31; 404/12

[58] Field of Search ..... 272/3, 4, 5, 56.5 SS, 272/56.5 R; 273/31, 195 R, 195 A, DIG. 13, DIG. 25, DIG. 55 R, 176 J, 176 E, 176 H; 47/35; 52/102; 404/10, 11, 12, 13, 14; 428/17

[56] References Cited

U.S. PATENT DOCUMENTS

| | | | |
|---|---|---|---|
| 391,660 | 10/1888 | Thayer | 273/31 |
| 1,193,571 | 8/1916 | Lord | 273/31 |
| 1,885,941 | 11/1932 | O'Brien | 404/12 |
| 2,196,601 | 4/1940 | Behr | 404/12 |
| 3,233,893 | 2/1966 | Meyer | 272/56.5 SS |
| 3,350,092 | 10/1967 | Maki | 272/56.5 SS |
| 3,541,726 | 11/1970 | Raschke, Jr. | 273/31 X |
| 3,995,079 | 11/1976 | Haas, Jr. | 428/17 |
| 4,044,179 | 8/1977 | Hass, Jr. | 428/17 |

FOREIGN PATENT DOCUMENTS

| | | | |
|---|---|---|---|
| 2,450,296 | 4/1976 | Fed. Rep. of Germany | 273/31 |
| 611,436 | 3/1935 | Fed. Rep. of Germany | 272/56.5 SS |
| 386,511 | 1/1933 | United Kingdom | 273/31 |
| 358,147 | 10/1931 | United Kingdom | 404/12 |

*Primary Examiner*—Richard C. Pinkham
*Assistant Examiner*—Arnold W. Kramer
*Attorney, Agent, or Firm*—Kremblas & Foster

[57] ABSTRACT

An improved permanent athletic boundary marking device which is characterized by a novel construction which includes an elongated base strip of flexible material provided with a plurality of spaced, integrally-formed and vertically extending projections. The base strip is adapted to be buried underground such that only the relatively closely spaced tips of the projections are visible to indicate the particular boundary marker used on athletic fields.

2 Claims, 4 Drawing Figures

PERMANENT ATHLETIC FIELD MARKER

BACKGROUND

Over many decades there has been various prior art constructions proposed for substitution of the more or less temporary means to mark the various boundaries of athletic fields. However to the present, most natural turf fields are still manually marked prior to each contest by either powdered compositions commonly referred to as "lime or chalk", or by paint compositions.

In spite of the cost and inconvenience of the manual labor required and the temporary nature of these markings, including deterioration during a given contest; no prior art construction of a permanent type maker has offered sufficient advantages or has been without significant disadvantages to motivate substitution of these old cumbersome means prior to the present invention.

The present invention solves many of the problems or disadvantages associated with prior art permanent athletic field markers and offers significant cost savings associated with minimizing maintenance and providing long useful life.

SUMMARY OF INVENTION

The present invention relates generally to permanent type athletic field markers and specifically to an improved construction which includes a base strip of a flexible material provided with integrally formed vertical projections. The base strip is adapted to be securely buried underground with only the tips of the closely spaced projections visible to indicate the boundary desired. This unique construction whereby an interrupted upper surface is utilized provides several significant advantages over the prior art types utilizing continuous visible surfaces while maintaining the primary function of providing a highly visible boundary margin.

OBJECTS

It is a primary object of the present invention to provide a permanent type of athletic field marker which offers significant improvements over prior art constructions as well as significant advantages over the temporary marking means presently being utilized.

It is another object of the present invention to provide a marker of the type described which is relatively easy to install and provides sufficient visual impression to clearly delineate the desired boundary to users and spectators.

It is another object of the present invention to provide a marker of the type described which has sufficient durability to withstand severe service conditions encountered in various athletic contests.

It is a further object of the present invention to provide a boundary marker of the type described wherein the unique construction minimizes interferences with the players efforts and presents no significant hazard should one fall upon the marker.

IN THE DRAWINGS

DETAILED DESCRIPTION

Figure 1:
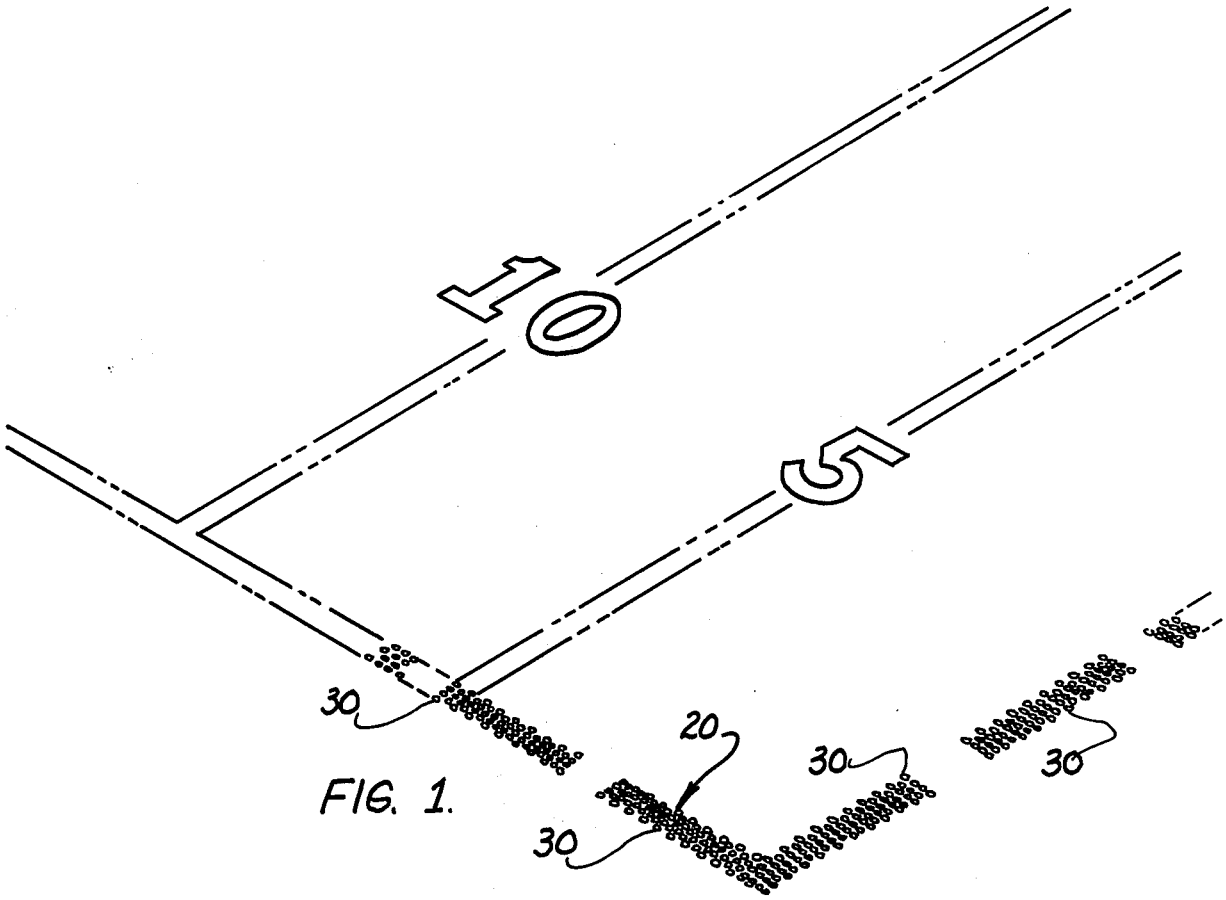
FIG. 1 is an illustration of a typical application of the present invention to indicate the sideline markers of a football field.

A permanent athletic field marker constructed in accordance with the present invention is illustrated as installed on a football field in FIG. 1 and indicated generally at 20.

Figure 2:
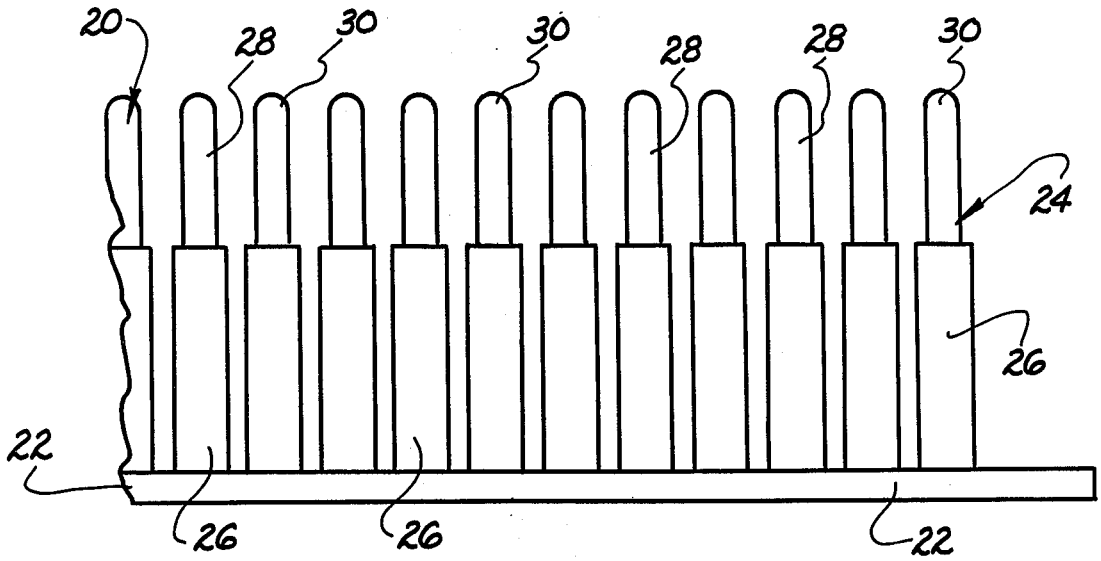
FIG. 2 is a side elevational view of a boundary marker constructed in accordance with the present invention.
Figure 3:
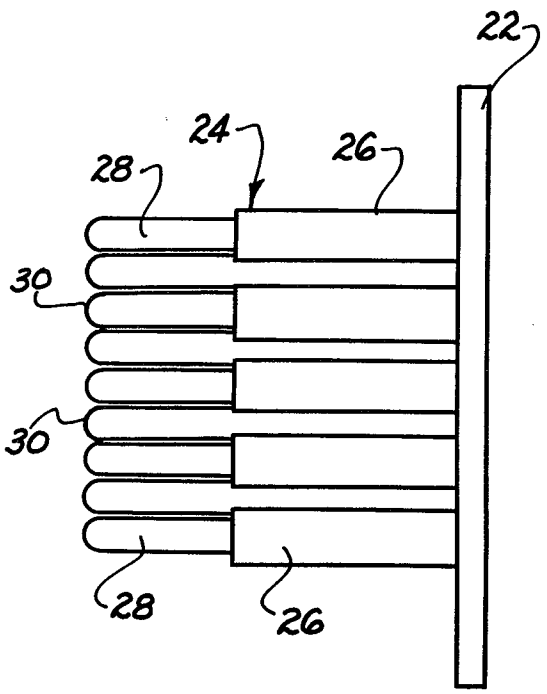
FIG. 3 is an end elevational view of the boundary marker shown in FIG. 2.
Figure 4:
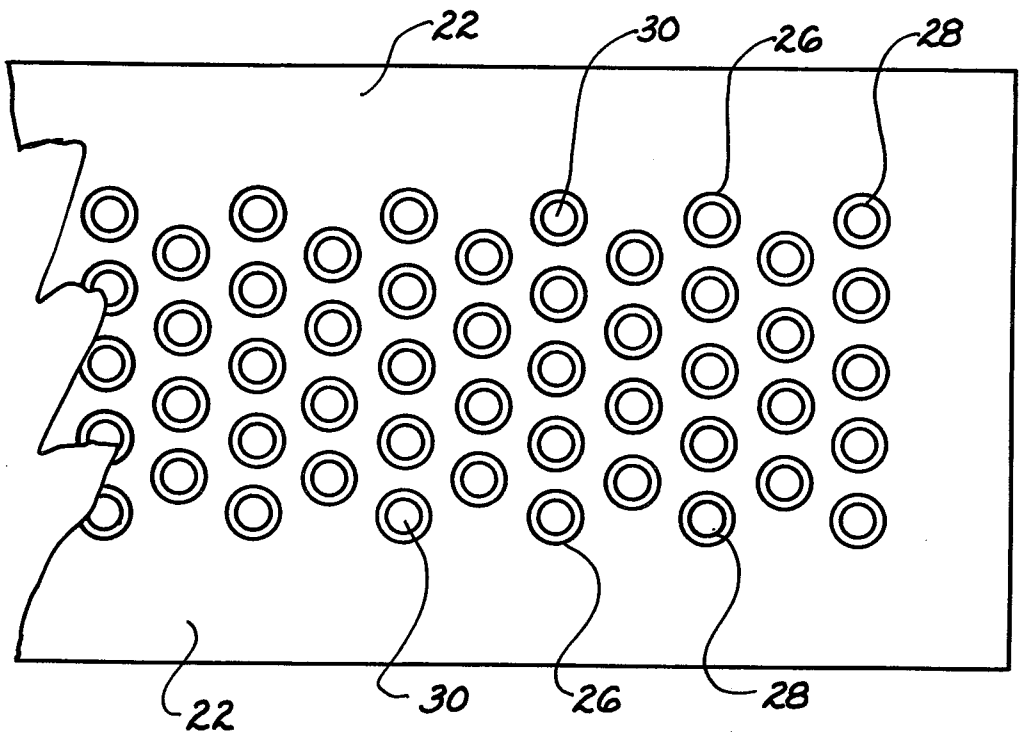
FIG. 4 is a top plan view of the boundary marker shown in the preceding figures.

As best seen in FIGS. 2, 3 and 4, marker 20 includes an elongated strip or base portion 22 and integrally formed vertically extending projections indicated generally at 24.

Preferably, the base 22 and projections 24 comprise a flexible material such as a natural or synthetic rubber or polycraton plastic material which can be molded to the required configuration.

The material should be highly flexible as well as reasonably abrasion resistant. White is a preferred color, however, other highly visible colors may also be used.

Still referring to FIGS. 2, 3 and 4 projections 24 are formed having a relatively thick stem portion 26, a narrow neck portion 28 and rounded tip portions 30.

Projections 24 are relatively closely spaced to one another and aligned in staggered rows to maximize the visual continuity of the tip portions 30 after installation while maintaining a sufficient space to permit soil to fill the spaces between each projection.

The stem portion 26 is thickened to provide greater strength and stability and the neck 28 is narrow to allow for greater flexibility.

The tip portion 30 is rounded to minimize any soil built up to obscure the tip after installation which would reduce visibility.

The height of the projections taken alone should be several times greater than the thickness or depth of base portion 22. This provides for securing the marker in position at sufficient depth underground to assure positive positioning and yet requires less raw material than a solid surface strip.

Also, the width of base portion 22 is preferably significantly greater than the distance between the projections 24 on each end of a laterally extending row to provide more area upon which soil may be placed to secure the marker in position in the ground.

Upon installation, as described later in detail herein, only the tip portions 30 are visible. However, they are of a size and closely spaced such that they present a visual impression of a clearly defined boundary functionally equivalent to a continuous or uninterrupted surface.

Installation of the marker of the present invention is relatively simple as a trench may be dug, of a depth approximately equal to the total height of the marker and slightly wider than the base portion 22.

Preferably, marker strip 20 is manufactured in given lengths which can vary at will relative to the ease of handling during installation. Strips 20 are then placed in the trench, end to end, until the desired length of the boundary is formed.

Relatively fine soil is placed in the trench over the strips 20 and water is added to achieve firm packing of the soil over the base 22 and in between the projections 24.

This procedure may be best accomplished by filling the trench partially with soil and adding water for packing the soil and then repeating these steps until only the tip portions 30 are visible. Since the soil generally settles, it may require additional soil at a later date to properly complete the installation.

It should also be noted that during this installation process as well as during use, the rounded tip portion 30 of the projections 24 resist any build-up of soil which would significantly impair visibility of the tips.

Further, the tip portions 30 are spaced such that when viewed as a whole, the interruptions between them become insignificant for the purpose of clear delineation of the boundary being defined for athletic purposes.

In the present invention, the interrupted visible surface provided offers several advantages for use on baseball, football and other similar athletic fields in several respects. The visibility is more than adequate and yet properly installed, the tips offer no significant interference with the game and importantly offers no substantial hazard to the players.

For example, the relatively soft, flexible material of the tips is either flush or only slightly protruding from the ground and will not cause slipping or tripping should a player step on the marker. A bouncing ball will not deviate to any significant degree as compared to the overall natural playing surface typically encountered should the ball land on the marker.

And importantly, the use of such an interrupted surface unlike prior art permanent markers, requires less material for construction to save cost and yet permits adequate depth to be maintained for secure installation.

Therefore, it should be readily appreciated that the construction of the present invention, by departing from the teachings of the prior art, provides a less costly and yet very effective means to provide a safe, durable, and non-interfering permanent boundary marker for athletic fields.

What is claimed is:

1. In combination, an athletic field and a permanent type of athletic field boundary marker comprising an elongated relatively narrow strip comprised of a flexible elongated base portion including a plurality of integrally formed and closely spaced upstanding projections, said projections having a height significantly greater than the depth of said base portion and having rounded tip portions, said base portion and projections being buried underground in said athletic field with only the tip portions of said projections being visible to clearly define a boundary marker when viewed from above ground.

2. In combination, an athletic field and a permanent type of athletic field boundary marker comprising, in combination, an elongated relatively narrow strip of flexible material integrally formed to provide a base portion having a plurality of closely spaced, upstanding projections having a length several times greater than the depth of said base portion, each of said projections having a stem portion immediately adjacent to said base portion, a narrower neck portion disposed above said stem portion and terminating in a rounded tip; said base portion and said projections being securely buried underground in said athletic field such that only said rounded tips are visible above the ground.

* * * * *